US012319323B2

(12) United States Patent
Veit

(10) Patent No.: US 12,319,323 B2
(45) Date of Patent: Jun. 3, 2025

(54) RAILROAD COIL CAR STRUCTURE

(71) Applicant: NATIONAL STEEL CAR LIMITED, Hamilton (CA)

(72) Inventor: Oliver Veit, Hamilton (CA)

(73) Assignee: National Steel Car Limited, Hamilton (CA)

( * ) Notice: Subject to any disclaimer, the term of this patent is extended or adjusted under 35 U.S.C. 154(b) by 837 days.

(21) Appl. No.: 17/394,571

(22) Filed: Aug. 5, 2021

(65) Prior Publication Data

US 2023/0038550 A1 Feb. 9, 2023

(51) Int. Cl.
*B61D 3/16* (2006.01)

(52) U.S. Cl.
CPC ..... *B61D 3/16* (2013.01)

(58) Field of Classification Search
CPC ... B61D 3/00; B61D 3/08; B61D 3/10; B61D 3/16; B61D 15/00; B61D 17/00; B61D 17/10
See application file for complete search history.

(56) References Cited

U.S. PATENT DOCUMENTS

| | | | |
|---|---|---|---|
| 2,810,602 | A | 10/1957 | Abrams |
| 3,291,073 | A | 12/1966 | James |
| 5,170,717 | A | 12/1992 | Richmond et al. |
| 5,336,027 | A | 8/1994 | Paddock |
| 6,543,368 | B1 | 4/2003 | Forbes |
| 6,579,048 | B2 | 6/2003 | Al-Kaabi |
| 6,637,990 | B2 | 10/2003 | Al-Kaabi |
| 6,739,268 | B2 | 5/2004 | Al-Kaabi |
| 6,749,381 | B2 | 6/2004 | Coslovi |
| 6,846,139 | B2 | 1/2005 | Al-Kaabi |
| 6,923,607 | B2 | 7/2005 | Al-Kaabi |
| 6,923,608 | B2 | 8/2005 | Rediehs |
| 7,234,904 | B2 | 6/2007 | Al-Kaabi |
| 8,366,361 | B1 | 2/2013 | Landrum |
| 9,387,864 | B2 | 7/2016 | Lydic et al. |
| 10,315,667 | B2 | 6/2019 | Thompson et al. |
| 10,589,757 | B2 | 3/2020 | Thompson et al. |
| 2002/0076289 | A1 | 6/2002 | Al-Kaabi |
| 2002/0076290 | A1 | 6/2002 | Al-Kaabi |
| 2003/0061961 | A1 | 4/2003 | Militaru et al. |
| 2003/0230214 | A1 | 12/2003 | Forbes |
| 2007/0234928 | A1 | 10/2007 | Al-Kaabi |
| 2020/0331505 | A1 | 10/2020 | Sandheinrich et al. |
| 2022/0396296 | A1 | 12/2022 | Black et al. |

FOREIGN PATENT DOCUMENTS

| | | | | |
|---|---|---|---|---|
| CA | 2328640 C | * | 5/2008 | ..... B61D 3/16 |
| CA | 2629133 C | | 10/2008 | |
| FI | 109009 B | | 5/2002 | |
| KR | 20140146013 A | | 12/2014 | |

* cited by examiner

*Primary Examiner* — Robert J McCarry, Jr.
(74) *Attorney, Agent, or Firm* — Hahn Loeser & Parks LLP

(57) ABSTRACT

A transverse trough coil car has a straight-through center sill. It has a pair of truck centers. It has a set of trough slope sheet assemblies mounted to the center sill between a pair of side sills. The slope sheet assemblies include intermediate slope sheet assemblies that are pin jointed connected to the center sill. The pin joint connection has a tongue and clevis form that is aligned with the webs of the center sill. The car may have stub bolsters that are surmounted by pre-fabricated trough assemblies that mate with the stub bolsters and extend to the side sills.

16 Claims, 13 Drawing Sheets

RAILROAD COIL CAR STRUCTURE

FIELD OF THE INVENTION

This invention relates to railroad freight cars, and more particularly to a railroad coil car.

BACKGROUND OF THE INVENTION

Railroad coil cars are used for carrying heavy coils of materials, quite often heavy coils of sheet steel such as are used in automobile manufacturing or other sheet metal manufacturing industries.

In a coil car, the coils can be carried with the axis of the coils parallel to the long axis of the railroad car. Such a coil car is termed a longitudinal coil car because it has a lengthwise running trough in which however many coils are carried. Such cars often have lateral coil stops to prevent the coils from moving axially in the trough. Alternatively, the coils can be transported with their axes oriented cross-wise to the long axis of the railroad car. In such a case, rather than having a single, central V-shaped trough running the length of the car, the coil car has several shorter troughs running across the car. Where the troughs run cross-wise, the railroad car is termed a "transverse trough coil car".

It is not desirable for a heavy coil of steel to be free to roll during carriage in the car. Coil cars are designed so that the weight of the lading coils is carried into the trough structure at points of tangency of the coil with the sloped sides of the trough. That is, the coil is effectively wedged between the sloped side sheets of the trough. This condition tends to prevent the coils from moving when the railroad car is in motion. The trough is designed such that the bottom of the trough has an included radius that is smaller than the lading coils for which the car is designed so that the points of tangency (or, really, given that the coils are cylindrical, the lines of tangency) lie on the sloped side sheets of the trough, not the bottom of the trough. When the coil sits in the trough, the bottom of the coil is suspended above the underlying structure at the bottom of the trough.

It may be that a coil of steel sheet may be relatively easily damaged by undesirably rough treatment during transport. Accordingly, coil cars may have long-travel draft gear or end of car cushioning units to soften deceleration. Where a coil car has a transverse trough, in addition to the structure for supporting the coils of lading during normal operation, there is also a requirement that the trough have a "trough peak" at either side of the trough to discourage escapement of the coils in the event that the coil car should stop abruptly. The trough peak is not intended normally to be contacted by the coils, but only in an abnormal operating condition.

The attachment of the trough structure to the center sill may tend to be challenging. The junction of the structure of the trough and the top flange of the center sill tends to cause a sharp change in the stress distribution in the structure. Additionally, it may be helpful for the trough structures to be manufactured and installed consistently, rather than varying from one assembly to the next.

SUMMARY OF THE INVENTION

In an aspect of the invention there is a railroad coil car. It has a straight-through center sill and a set of transverse troughs that includes at least a first transverse trough and a second transverse trough. There is an intermediate slope sheet assembly that defines a first slope sheet of the first trough and a first slope sheet of the second trough. The intermediate slope sheet assembly is pin-joint connected to the straight-through center sill.

In a feature of that aspect, the center sill has a planar top cover plate. In another feature, the center sill has a top cover plate and the pin-joint connection has a root having web continuity through the top cover plate of the center sill. In a further feature, the center sill is a fish belly center sill. In still another feature, the first slope sheet of the first trough is pin-jointed to both the center sill and pin-joint connected to a first trough peak. In an additional feature the center sill has one of (a) a clevis; and (b) a tongue. The first slope sheet has the other of (a) a tongue and (b) a clevis, and the respective tongue and clevis are connected by a pin to define the pin joint.

In another feature, the intermediate slope sheet assembly includes at least one A-frame structure having a pair of first and second legs, each of the first and second legs having a foot that is pin-joint connected to the straight-through center sill. In an additional feature, the intermediate slope sheet assembly has two of the A-frame structures. A first of the A-frame structures is aligned with a first web of the center sill, and a second of the A-Frame structures is aligned with a second web of the center sill spaced apart from the first web. In still another feature, the intermediate slope sheet assembly includes a head frame member, and the first and second legs of the at least one A-frame have uppermost ends connected to the head frame. In another feature, the head frame has a web that has a profile defining a trough peak form of the intermediate slope sheet assembly.

In yet another feature, the first slope sheet has at least a first lateral reinforcement, the first lateral reinforcement having a termination at a side sill of the coil car. and the reinforcement having a cuff rigidly connected to the side sill, the cuff being adjustable on fit-up during assembly, and the cuff being rigidly fixed to the reinforcement on assembly. In a still further feature, the first slope sheet has at least a first lateral reinforcement and a second lateral reinforcement extending cross-wise behind the slope sheet. The first lateral reinforcement being a lower reinforcement and the second lateral reinforcement being an upper reinforcement. The upper reinforcement has a different cross-section from the lower reinforcement.

In still another feature, the upper reinforcement has at least one of: (a) a greater second moment of area in bending perpendicular to the first slope sheet than has the lower reinforcement; (b) a greater sectional thickness than the lower reinforcement; and (c) a greater weight of metal per lineal unit of run than the lower reinforcement. In another feature, the lower reinforcement is a channel section and the channel section has splayed legs. In another feature the upper reinforcement is a channel section having parallel legs. The lower reinforcement is a channel section having splayed legs. and the upper reinforcement has a greater flexural modulus, EI, than has the lower reinforcement. In another feature the intermediate slope sheet assembly has end cap plates, and the end cap plates are welded to side sills of the coil car.

In yet another aspect, there is a transverse trough coil car having a stub bolster and a transverse trough mounted across the stub bolster. The transverse trough defines a bolster extension extending laterally across the car outboard of the stub bolster.

These and other aspects and features of the invention may be understood with reference to the illustrative drawings.

BRIEF DESCRIPTION OF THE DRAWINGS

In the description that follows there is reference to the drawings in which.

DETAILED DESCRIPTION

Figure 1A:
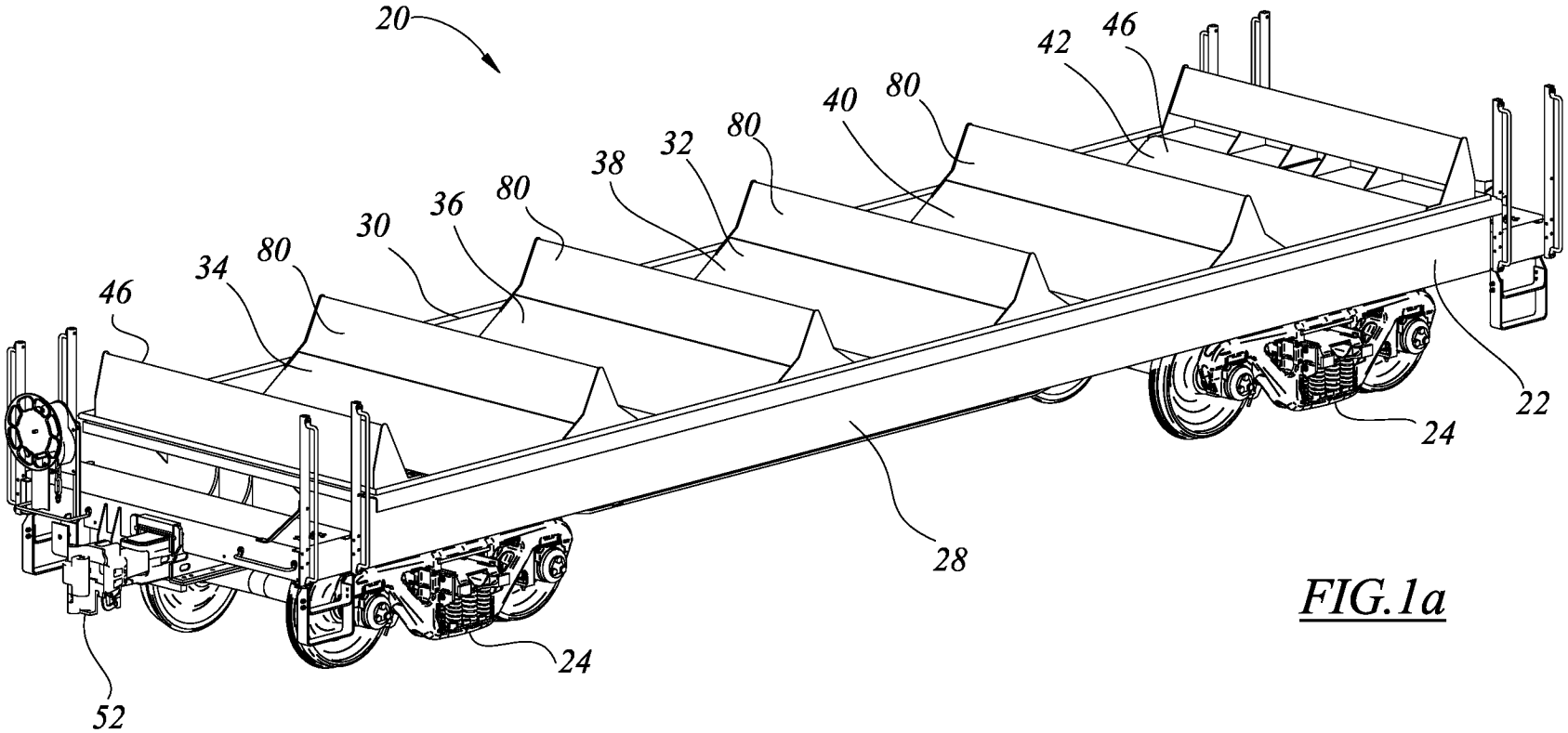
FIG. 1*a* is a general arrangement isometric view of a railroad coil car viewed from the "B" end of the car.

The description that follows, and the embodiments described therein, are provided by way of illustration of examples of, particular embodiments of the principles, aspects or features of the present invention. These examples are provided for the purposes of explanation, and not of limitation, of those principles and of the invention. In the description, like parts are marked throughout the specification and the drawings with the same respective reference numerals. The drawings may be taken as being to scale unless noted otherwise.

The terminology in this specification is thought to conform to the customary and ordinary meanings of those terms as they would be understood by a person of ordinary skill in the railroad industry in North America. Following the decision of the CAFC in *Phillips v. AWH Corp.*, the Applicant expressly excludes all interpretations that are inconsistent with this specification, and, in particular, expressly excludes any interpretation of the claims or the language used in this specification such as may be made in the USPTO, or in any other Patent Office, other than those interpretations for which express support can be demonstrated in this specification or in objective evidence of record in accordance with In re Lee, (for example, earlier publications by persons not employed by the USPTO or any other Patent Office), demonstrating how the terms are used and understood by persons of ordinary skill in the art, or by way of expert evidence of a person or persons of at least 10 years' experience in the industry in North America.

In terms of general orientation and direction, for railroad car body units described herein the longitudinal direction is defined as coincident with the rolling direction of the railroad car when on tangent (that is, straight) track. In a Cartesian frame of reference, this is the x-axis, or x-direction. The longitudinal direction is parallel to the center sill, and parallel to the top chords and side sills. Unless otherwise noted, vertical, or upward and downward, are terms that use top of rail, TOR, as a datum. In a Cartesian frame of reference, this may be defined as the z-axis, or z-direction. In the context of the railroad car as a whole, or any car body unit thereof, the term lateral, or laterally outboard, or transverse, or transversely outboard refer to a distance or orientation relative to the longitudinal centerline of the railroad car, or car body unit, or of the centerline of a centerplate at a truck center. Given that the railroad car or railroad car body units described herein may tend to have both longitudinal and transverse axes of symmetry, unless noted otherwise, a description of one half of the car may generally also be intended to describe the other half as well, allowing for differences between right-hand and left-hand parts. As such, the term "longitudinally inboard", or "longitudinally outboard" is a distance taken relative to a mid-span lateral section of the car, or car unit. Pitching motion is angular motion of a railcar unit about a horizontal axis perpendicular to the longitudinal direction (i.e., rotation about an axis extending in the y-direction). Yawing is angular motion about a vertical or z-axis. Roll is angular motion about the longitudinal, or x-axis. The abbreviation kpsi, if used, stands for thousands of pounds per square inch. Where this specification or the accompanying illustrations may refer to standards of the Association of American Railroads (AAR), such as to AAR plate sizes or lading rules, those references are to be understood as at the earliest date of priority to which this application is entitled. Unless otherwise noted, it may be understood that the railroad cars described herein are of welded steel construction. The commonly used engineering terms "proud", "flush" and "shy" may be used herein to denote items that, respectively, protrude beyond an adjacent element, are level with an adjacent element, or do not extend as far as an adjacent element, the terms corresponding conceptually to the conditions of "greater than", "equal to" and "less than".

Railroad coil cars are the predominant car type for carrying metal coils, and particularly coils of steel. The coil car may be covered or uncovered, depending on the circumstances. Cars for carrying transversely-oriented coils are described herein. The coil cars describe herein have a longitudinally running center sill and a pair of side sills located to either side of the center sill.

In the past, coil cars have had straight-through center sills that carry the longitudinal buff and draft loads to which the car is subjected, and also the vertical bending load. The center sill may have had a flat horizontal upper flange extends the full length of the car from draft sill to draft sill. Transverse troughs are then mounted above the center sill. Coil cars may have "fish belly" center sills. The term "fish belly" arises from the shape of the beam in side view in which the bottom flange of the center plate dips downward between the trucks, giving a greater depth of section in the middle portion of the car than at the draft sills, and hence a higher flexural moment, EI, for resisting bending, giving the general appearance of a "fish belly".

In railroad terminology the "draft sill" is that portion of the center sill lying longitudinally outboard of the truck center. A single unit rail car typically has two draft sills, one at each end of the car. In some instances, e.g., where the draft sill is made as a unitary casting or as a pre-fabricated assembly, the draft sill extends inboard of the truck center for a short distance to allow for the draft sill to mate with the main portion of the center sill inboard of the truck center and inboard of the main bolster. The draft sill is typically sized to fit the draft gear. That is, the draft sill typically has two vertical webs that are laterally spaced apart a distance sufficient to form a draft pocket in which to mount the draft stops and to receive the draft gear, the yoke, and the coupler. The draft sill has a top cover plate, or top flange to which the webs are welded. The draft sill also typically has a bottom sill that extends outboard of the truck center and that bifurcates to permit the draft gear to be installed in the draft pocket. The top cover plate of the draft sill is usually considered to be the top of the center sill, and is located at a height determined by the requirements of the coupler centerline height. Generally, the top cover plate of the draft sill is located roughly 41"-42" above Top of Rail. The flange defined by the top cover height of the draft sill is a defined datum height in this specification.

The term "stub bolster" is used in this specification. A stub bolster is a laterally fore-shortened bolster having a bottom flange, a top flange and at least one vertical web interconnecting the top and bottom flanges. The bottom flange extends laterally to define a seat for the side bearing, and is truncated outboard of the side bearing mount. Likewise, the bolster web, or webs, terminate outboard of the side bearing mount. A stub bolster, by definition, does not extend to the side sills of the car.

FIGS. 1*a*, 1*b*, 1*c*, and 2*a* show a railroad coil car, generally as 20. Other than as indicated, the major structural elements of coil car 20 are symmetrical about the longitudinal vertical plane (or x-z plane) of the car and also about the lateral vertical plane. Coil car 20 has a railcar body unit 22 supported upon railcar trucks 24 for rolling motion in the longitudinal direction along the rails.

Railcar body unit 22 includes a center sill 26 and a pair of first and second, spaced apart side sills 28, 30. Coil car 20 has a set of troughs 32. In the example shown the troughs are transverse and include first, second, third, fourth and fifth troughs 34, 36, 38, 40 and 42. There could be fewer troughs, but there could also be more troughs, as many as ten or twelve, depending on the maximum size and type of coils of lading that the car is intended to carry. These troughs are supported by center sill 26 and extend between, and are bounded laterally by, side sills 28 and 30. Between pairs of adjacent troughs there are slope sheet assemblies 44 and at the ends of the car are end slope sheet assemblies 46. Trough slope sheet assemblies 44 are double-sided and end slope sheet assemblies 46 are single-sided. Slope sheet assemblies 44 and 46 mount to center sill 26.

These various components of coil car 20 will now be described in greater detail, commencing with center sill 26.

Center sill 26 is a straight-through center sill (as opposed to a stub center sill). It forms the central spine of the car and carries the buff and draft loads along the trainline from coupler to coupler. It also provides the dominant resistance to vertical bending, although part of the car's resistance to vertical bending is also contributed by side sills 28 and 30. In the example shown, center sill 26 includes draft sills 48 and a central or intermediate center sill portion 50 that extends the length of the car between the truck from draft sill to draft sill. Draft gear, including couplers 52, are mounted at the outboard ends of draft sills 48. Coil car 20 may have, and in the example illustrated does have, either long-travel draft gear or and end-of-car-cushioning (EOCC) unit.

Each of draft sills 48 has a pair of side webs 54 and a top cover plate 56, and a bifurcated bottom flange, or flanges 58 that form a top hat section that is open from the bottom to admit installation of the EOCC in the draft pocket 60. Coupler 52 has a coupler centerline height $h_{52}$ relative to Top of Rail (TOR). The top cover plate of draft sill 48 also has a height, $h_{56}$, relative to TOR that is a datum height in this discussion. Draft sill 48 may have, and as illustrated does have, a welded-fabrication truck center assembly. This assembly, and the draft sill generally, may alternatively be a single-piece casting.

In the fabricated assembly of draft sill 48 shown, a main bolster 62 intersects draft sill 48 at the truck center. Main bolster 62 may be a bolster that extends fully across the car and has and connections to side sills 28, 30. Alternatively, main bolster may be, and in the example illustrated is, a stub bolster that terminates immediately outboard of the side bearing mount 64.

A draft sill may include, and in the example illustrated does include, a transition, or stub 66 that extends for some distance longitudinally inboard of the truck center. Transition stub 66 mates with one end of central or intermediate center sill portion 50.

Intermediate center sill portion 50 has a top flange or top cover plate 72, a bottom cover plate, or bottom flange 74, and first and second side webs 76, 78. They co-operate to form a hollow section in which side webs 76 and 78 are spaced apart and parallel, and lie in vertical planes. Similarly top cover plate 72 and bottom flange 74 are spaced apart, and at any given longitudinal section they are parallel in the y-axis. In the embodiment illustrated, top cover plate 72 of center sill intermediate portion 50 lies in the same plane as top cover plate 56 of draft sill 48. In the embodiment as shown top cover plate 56 may be a straight continuation of top cover plate 72, formed from the same monolith of material, i.e., rather than butt-welding the parts together.

Figure 1B:
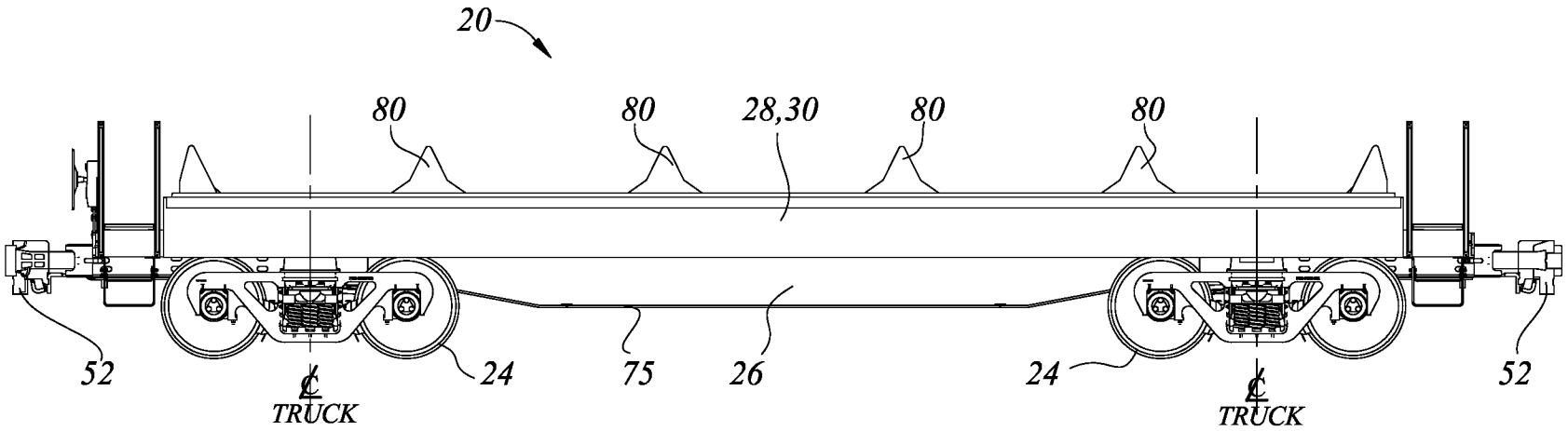
FIG. 1*b* is a side view of the railroad coil car of FIG. 1*a;*
Figure 1C:
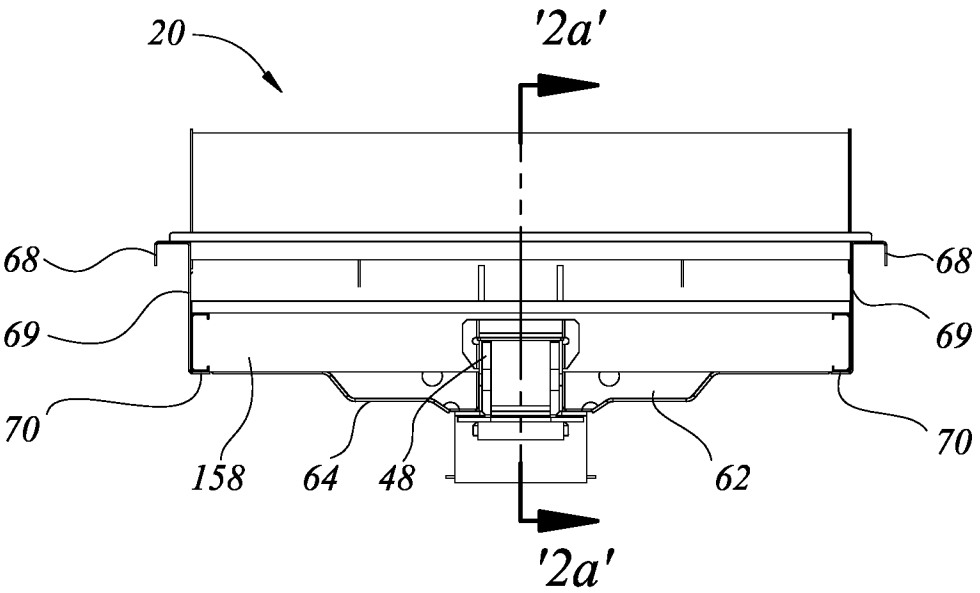
FIG. 1*c* is an end view of the railroad col car of FIG. 1*a;*
Figure 2A:
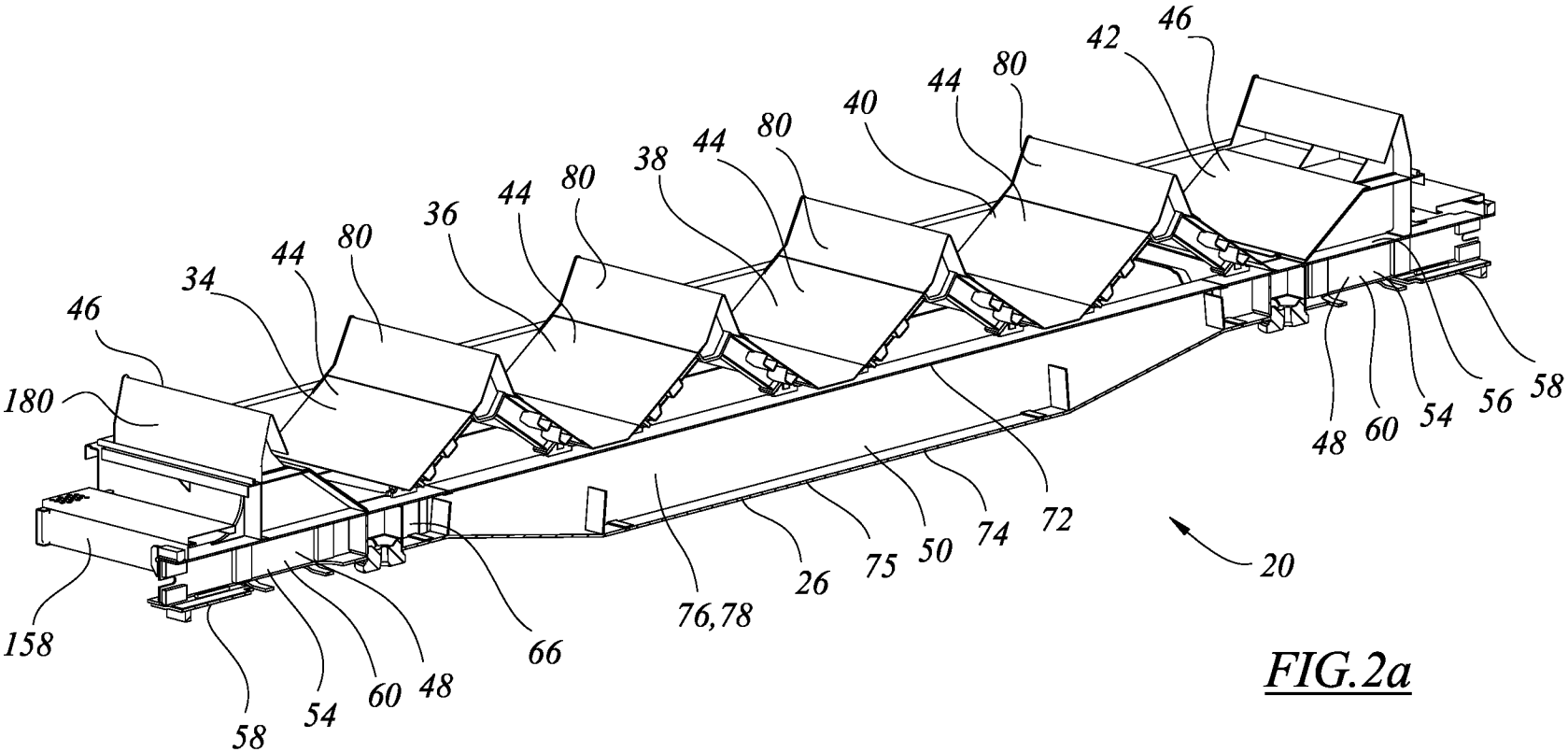
FIG. 2*a* is a sectional view of the railroad coil car of FIG. 1*c* taken on a central vertical plane in the middle of the center sill on section '2*a*-2*a*' of FIG. 1*c;*
Figure 2B:
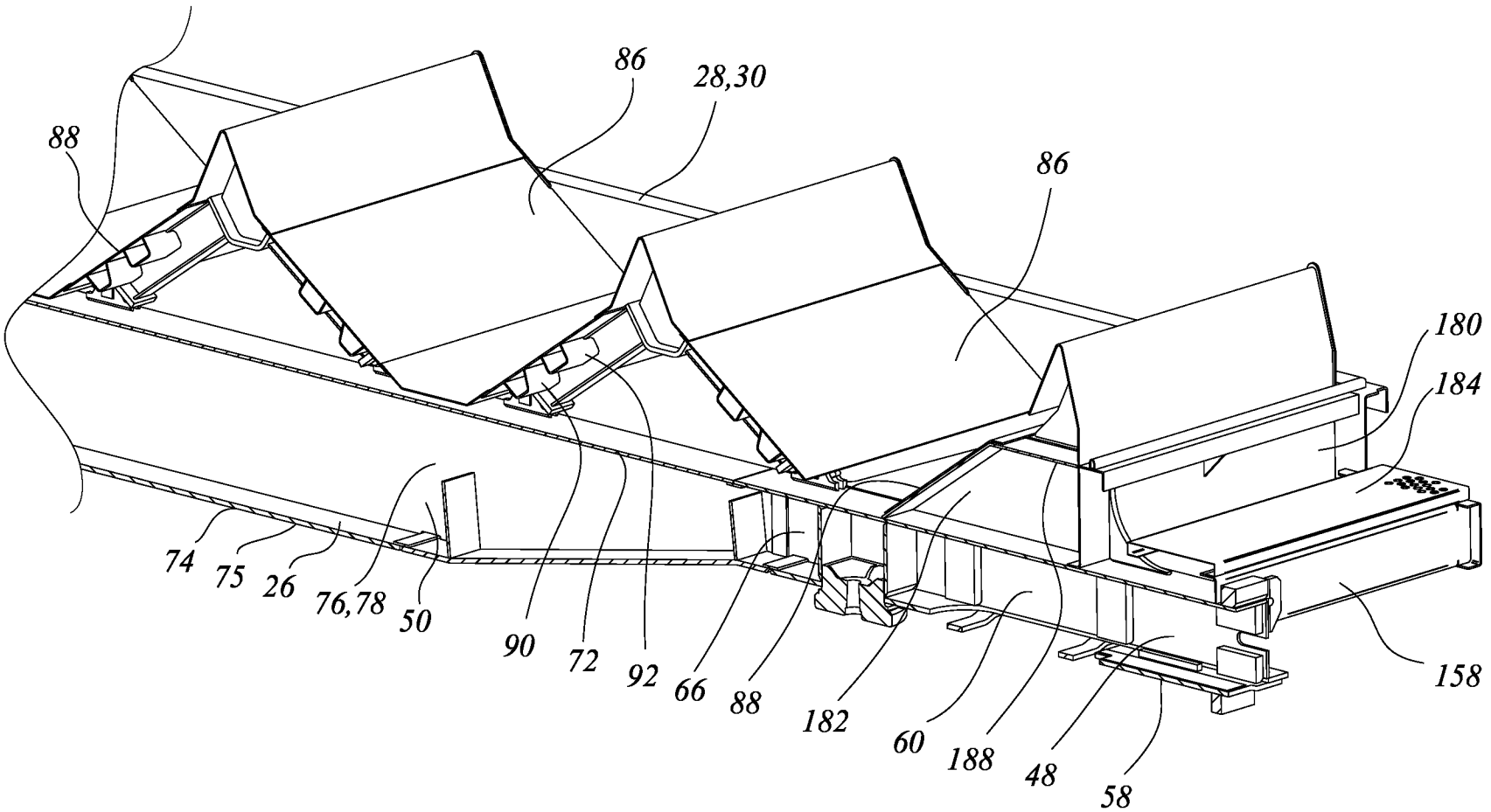
FIG. 2*b* is an enlarged near-end portion of the view of FIG. 2*a;*
Figure 2C:
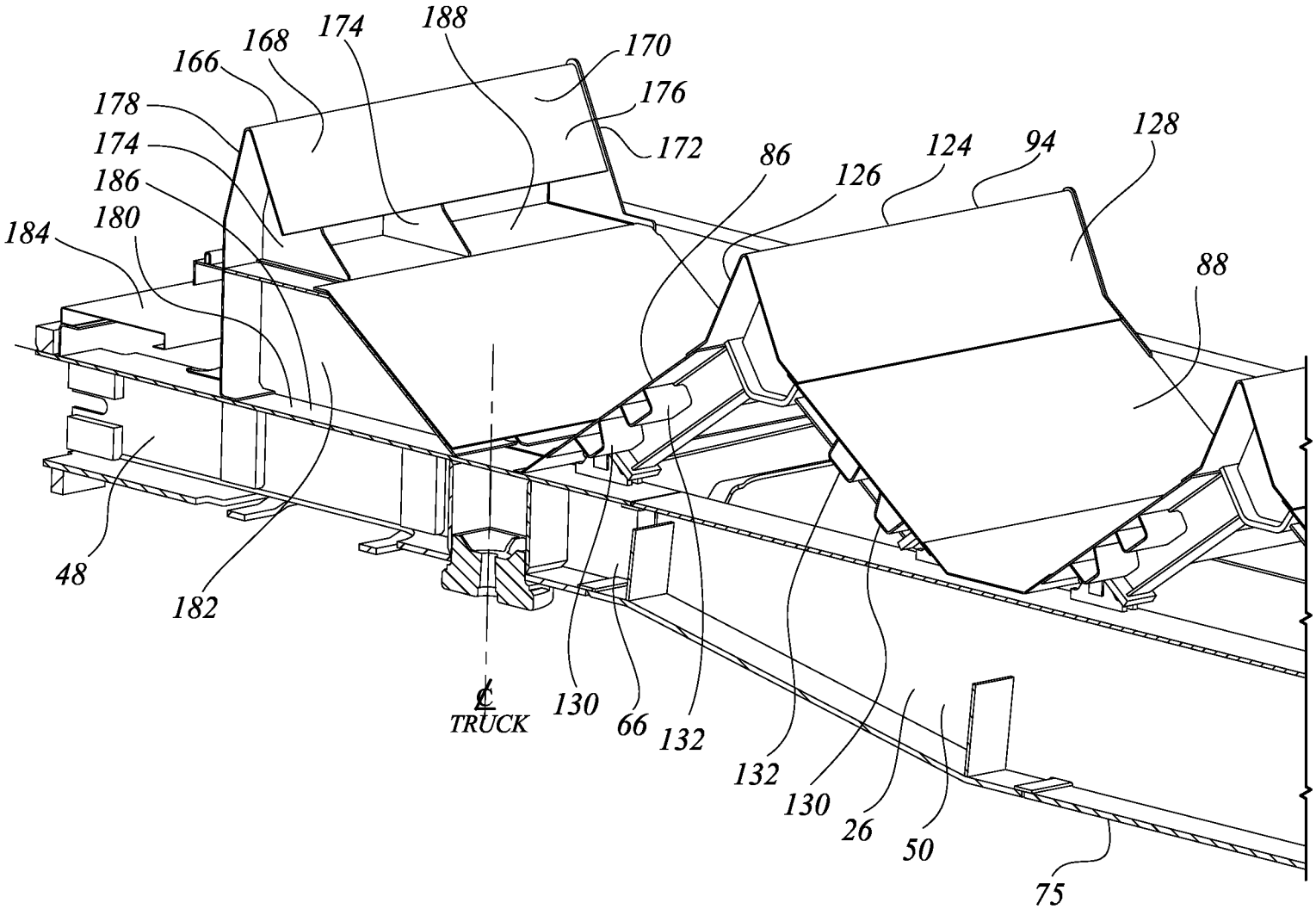
FIG. 2*c* is an is a view similar to FIG. 2*b* from the opposite direction.

Bottom flange 74 could be flat and horizontal. Alternatively, as seen in FIGS. 1*a*, 1*b* and 1*c*, center sill 26 is a fish belly center sill, the deeper portion of the center sill that defines the fish belly as indicated at 75. Bottom flange 74 may be, and in the embodiment illustrated is, a "fish belly" bottom flange, i.e., the depth of the bottom flange 74 below the coupler centerline datum height (or, expressed differently, the draft sill cover plate datum height) increases toward the longitudinal center of the car such that the bottom flange is lower at the location of maximum bending moment than it is at the truck centers and at the bottom flange of the draft sill.

As noted, top cover plate 72 can also be named the top flange of center sill 26. It can be seen that top cover plate 72 of center sill 26 is at the datum height of draft sill top cover plate 56 at the truck center. First trough 34 and fifth trough 42 are centered over the respective truck centers at opposite ends of car 20. Three full troughs 36, 38, and 40 are space along, and mounted to, central portion 50 of center sill 26.

The next structural components of the underframe of coil car 20 are side sills 28 and 30. Side sills 28, 30 run parallel to and are spaced laterally from center sill 26. Side sills 28 and 30 each have a top chord 68, a bottom chord 70, and a web 69 that extends and joins top chord 68 and bottom chord 70 together. In the illustrations, top chord 68, bottom chord 70, and web 69 are formed as a single formed section, which may be a pressing. The pressing may include an upwardly protruding, longitudinally extending stand-off bead formed in top chord 68, and may carry a seal upon which the coil car cover may sit, if provided.

Figure 3:
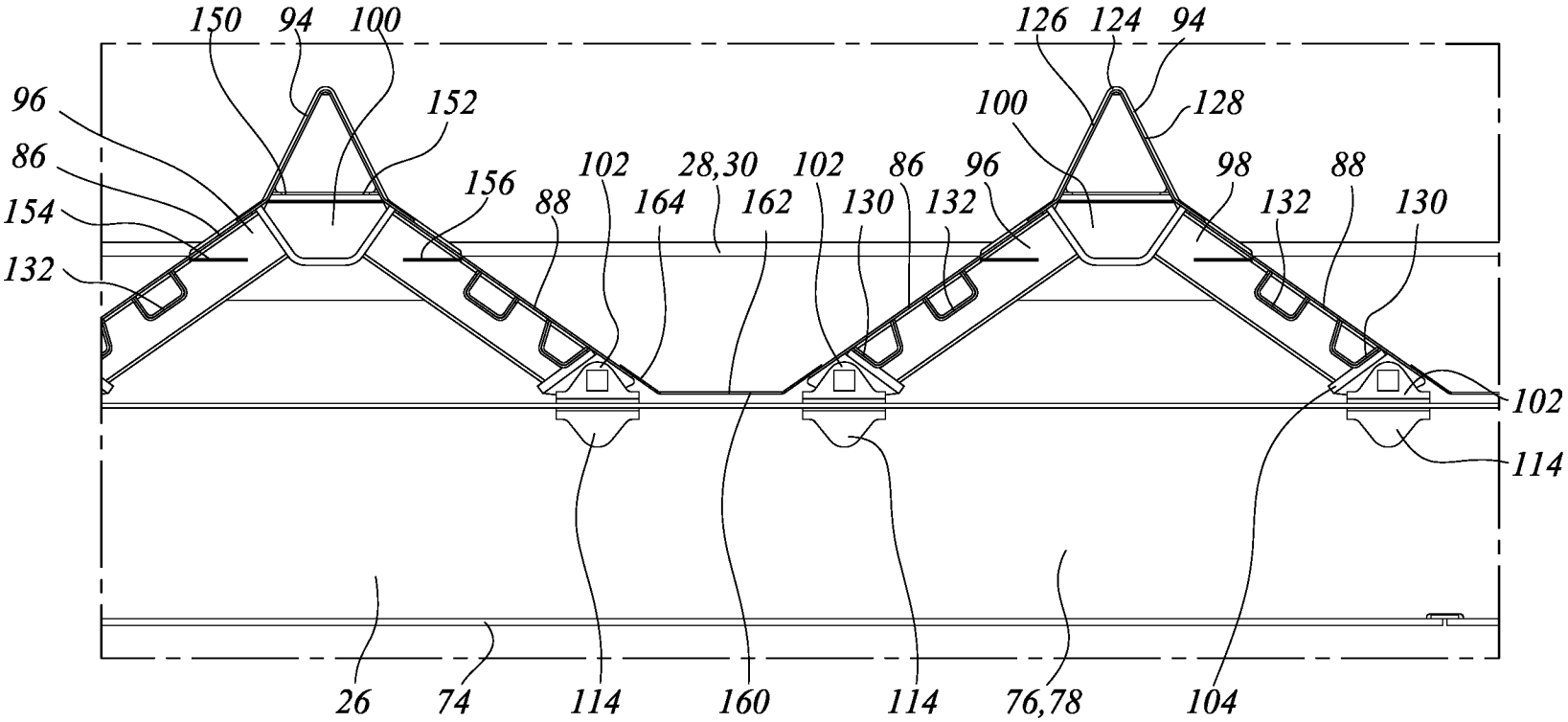
FIG. 3 is an enlarged sectional view through the section of the trough structure of the coil car of FIG. 2*a;*
Figure 4A:
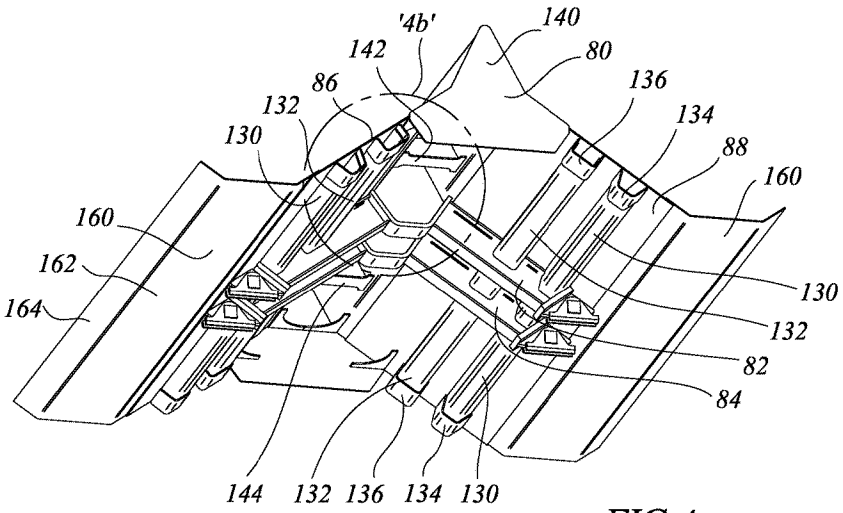
FIG. 4*a* is an isometric section from underneath of the trough structure of FIG. 3.
Figure 4B:
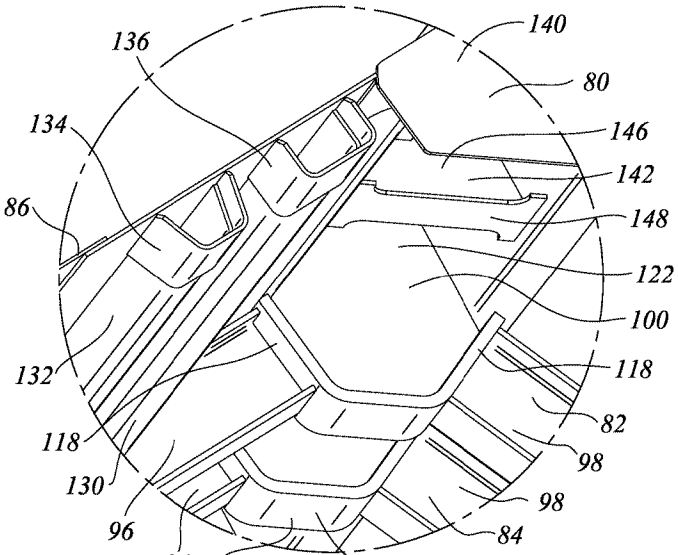
FIG. 4*b* is an enlarged detail of the structure of FIG. 4*a;*

In FIG. 3 there is a cross-section of an intermediate slope sheet assembly 80, such as would lie between, and define, the sides of the respective troughs. There is a trough slope sheet assembly between troughs 34 and 36, a second between troughs 36 and 38, a third between troughs 38 and 40, and a fourth between troughs 40 and 42.

Each trough sheet assembly 80 includes a pair of central A-frames 82, 84; and a pair of first and second slope sheets 86, 88. Slope sheets 86, 88 extend from side to side of car 20 and are joined at their ends to side sills 28, 30. Each slope sheet is backed by first and second reinforcements 90, 92 that run laterally behind them. The top of each assembly 80 includes a trough peak assembly 94.

Each A-frame 82 or 84 has first and second legs 96, and 98 that underlie the respective slope sheets 86 and 88. There is a head frame, or head frame assembly, 100 at the apex of the A-frame. Each of first and second legs 96, 98 is a formed structural member, such as an I-bean, a wide-flanged beam, or a hollow structural section. In the example illustrated they are I-beams in which the upper flange underlies, and is welded to the respective slope sheet, be it 86 or 88. First and second legs 96, 98 each have a footing 102 that has the form of a cap, or end plate 104 welded across the lower end of the I-beam of leg 96 or 98, and a tongue 106 welded to the end plate. Tongue 106 protrudes from plate 104 perpendicularly to seat between a pair of side plates 108, 110 that form a clevis. A pin 112 passes through bores in side plates 108, 110 and through tongue 106 in a double shear arrangement. Tongue 106 thereby has a degree of freedom of motion relative to the clevis, that degree of motion being a rotational degree of freedom about the axis of pin 112. The bottom edges of side plates 108, 110 are welded to the top flange, i.e., the top cover plate 72 of center sill 26.

Figure 5C:
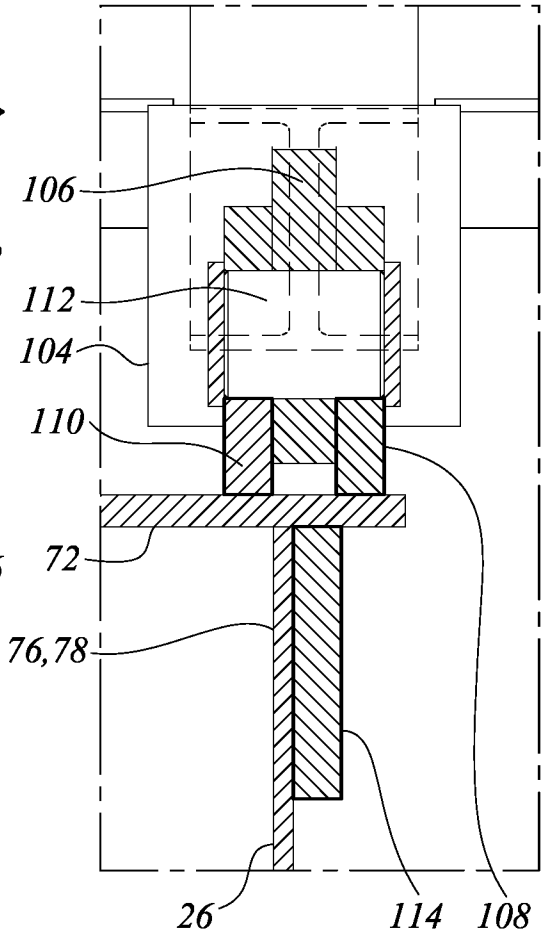
FIG. 5*c* is an enlargement of a portion of the detail of FIG. 5*b;*
Figure 5B:
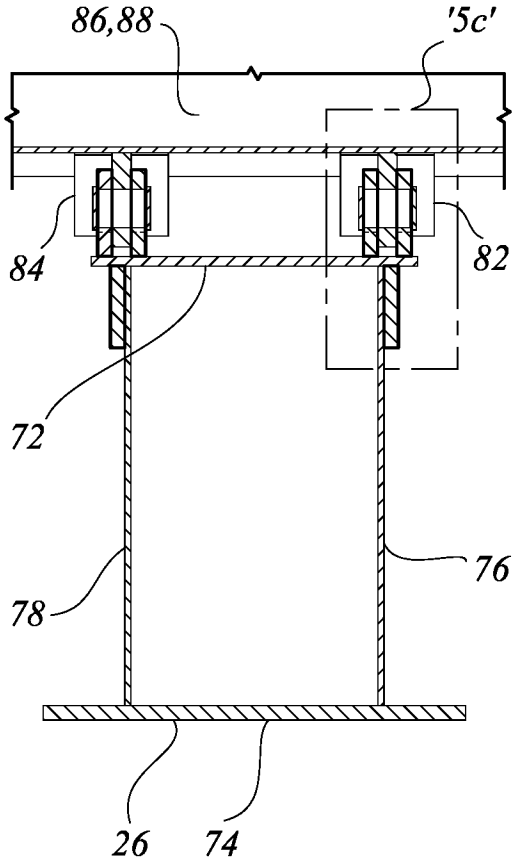
FIG. 5*b* is an enlarged sectional detail on FIG. 5*b*-5*b* of FIG. 5*a;*
Figure 5A:
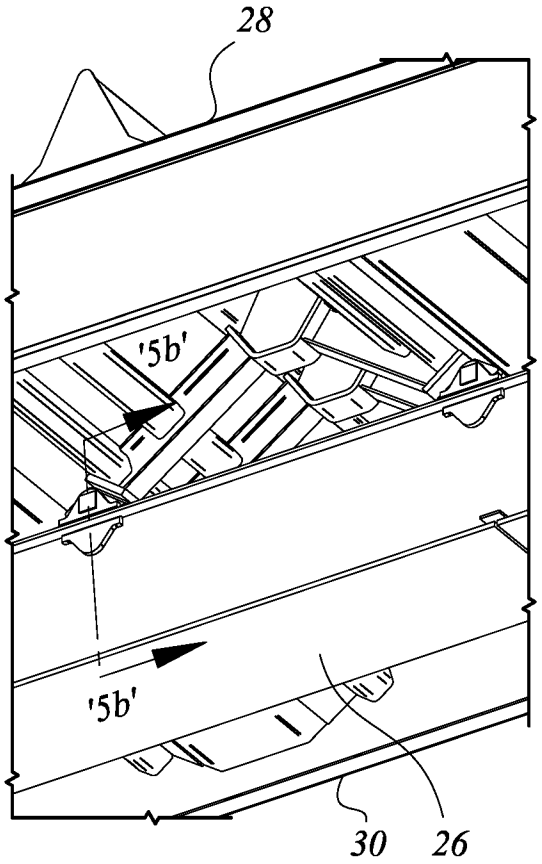
FIG. 5*a* is partial isometric view of the underside of the center sill of the coil car of FIG. 2*a;*

As seen in FIGS. 5*a*, 5*b* and 5*c*, a web reinforcement, or doubler, 114 is welded to the outside face of the respective ones of webs 76, 78 immediately abutting the underside of top cover plate 72, opposite tongue 106. As seen in FIG. 5*c* the combined width of web 76, 78 and doubler 114 is the same as the thickness of tongue 106 such that they effectively form the root of the clevis formed by side plates 108, 110, whose inside faces are co-planar, or roughly co-planar with the corresponding faces of web 76, 78 and doubler 114.

At the top of legs 96, 98 head frame 100 has a cap plate 116 that has portions 118 that define lands that are welded across the top ends of the I-beam legs 96, 98. Cap plate 116 also has a central portion 120 that ties portions 118 together. Head frame 100 also has a central web 122 that is welded to, and forms a stem of, portions 118 and 120. Additionally, trough peak assembly 94 has a cover 124 that includes first and second members, or first and second sides identified as a pair of first and second skirts 126, 128 that are welded to remaining edge portions of central web 122. Head frame 100 is effectively a structural knee.

Additionally, trough slope sheet assembly 44 has a set of laterally extending reinforcement 90, 92 in which first reinforcement 90 is a lower stringer 130 and second reinforcement 92 is an upper stringer 132. Lower stringer 130 and upper stringer 132 extend across the rail car from side sill to side sill. They have web continuity through the I-beams of the A-frames. At the laterally outboard ends there are sockets or cuffs 134, 136 that are welded to the respective side sills on installation. Cuffs 134, 136 are able to slide on stringers 130, 132 such that their axial position can be adjusted on fit up, and once installed stringers 130, 132 are welded in place in the cuffs.

Upper stringer 132 may be different from lower stringer 130. That is, to the extent that coils engage the slope sheets, larger diameter, heavier coils will engage the slope sheets at a higher location. Accordingly, upper stringer 132 may have a heavier section, or specifically, a larger second moment of area and a larger flexural modulus than lower stringer 130. Moreover, whereas upper stringer 132 may have the form of a channel with parallel legs welded toes-in to the back side of the respective slope sheet 86, 88, lower stringer 130 may have toes that are splayed apart, such that the lower leg is welded closer to the lower margin of slope sheets 86, 88 to provide more proximate reinforcement to that edge than if lower stringer 130 had been a channel with square legs rather than splayed legs.

Trough peak assembly 94 extends across the car between side sills 28, 30. At the laterally outboard ends there are end plates 140 that cap the ends of cover 124, and to which the ends of skirts 126, 128 are welded. Skirts 126, 128 are inclined upwardly toward each other, and are joined at the peak where cover 124 is bent between them. The slope of inclination of skirts 126, 128 is steeper than the slope of slope sheets 86, 88. End plates 140 have an upper portion that is generally triangular to correspond to the slope of skirts 126, 128 and to extend slightly beyond them. End plates 140 have a lower portion that forms a generally polygonal-shaped foot or base that has angled upper side margins that run along the upper portions of the outboard edges of slope sheets 86, 88, a truncated edge that runs away from that edge, and a bottom edge that runs horizontally. The base or bottom edge overlaps, and is lap welded to, the inside margin of the top chord of the side sill 28, 30.

As indicated, the ends of trough peak assembly 94 are capped by end plates 140 and fixed in position by the welded connection of end plates 140 to side sills 28, 30. The central portion of trough peak assembly 94 is mounted to the laterally spaced apart head frames 100 of A-frames 82, 84. In addition, there is a pair of internal gussets 142, 144 that each have an upstanding web 146 that conforms to, and reinforces, the profile of peak assembly 94. A horizontally extending flange 148 runs along the bottom edge of web 146 and has broadened end tabs that butt against, and are welded to the lower margins of skirts 126, 128 immediately upward of the bend of those lower margins. Internal gussets 142, 144 function as formers or frames to hold the shape of trough peak 94, and are located mid-way between end plates 140 and A-frames 82, 84 respectively.

Figure 6:
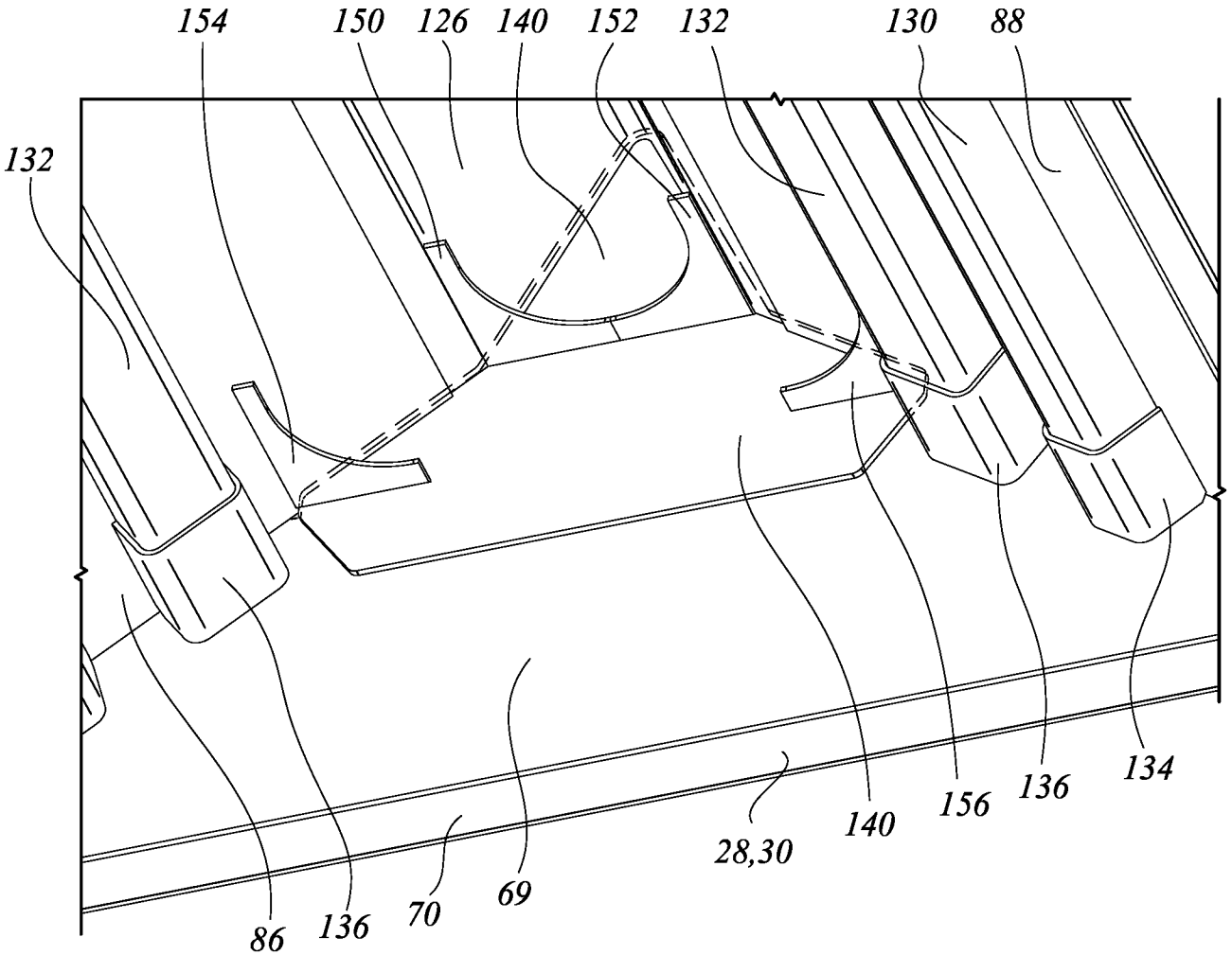
FIG. 6 is a perspective view from below of the juncture of an intermediate slope sheet assembly and a side sill of the railroad coil car of FIG. 1*a;*

The lower edges of skirts 126, 128 are bent to conform to the slopes of slope sheets 86, 88. These lower edges lap over the upper edge of slope sheets 86, 88, to which they are welded. Internal corner gussets 150, 152 lie in a horizontal plane at the corner of the bends of the lower margins of the skirts, as seen in FIG. 6. Similarly, additional corner gussets 154, 156 are located in a horizontal plane level with, or approximately level with, the top chord flange of side sills 28, 30, with one leg welded to end cap 140 and the other leg welded to the underside of slope sheet 86, 88.

The lower edges of slope sheets 86, 88 underlie, and are mated in a lap joint with, a trough bottom in the form of a pan 160 that has a central web 162 and upturned edges 164 that may be bevelled upwardly as shown. The bevelled edges, or flanges, are on the same slope as the slope sheets 86, 88. When assembled in this manner, each pan 160 and adjoining pair of slope sheets 86, 88 combine to form a V-shaped channel, in which the pan functions as the back or flange of the channel, and the slope sheets function as the legs or webs of the channel.

As may be noted, each intermediate slope sheet assembly 80 can be assembled as a module, or sub-assembly, and then be inserted into the car between side sills 28, 30 as a unit. It is secured to center sill 26 at pins 112. Pins 112 are not able to transmit a bending moment in the x-z plane. That is, when car 20 is subject to buff and draft loads, center sill 26, and therefore top cover plate 72, may tend to stretch or compress. This action causes shear loads in the x-direction to be transmitted into intermediate slope sheet assemblies 80 at pins 112. However, that force transfer may tend not to be accompanied by a moment about the y-axis that might otherwise tend to want to impose a bending moment on center sill 26, and top cover plate 72, otherwise tending to rotate the element and to cause a local rotational discontinuity in the stress field in the center sill at that location.

Center sill 26 and side sills 28, 30 form the dominant structural members of the underframe of coil car 20. The center sill and side sills are joined by lateral structural members. In car 20 there are also lateral structural members joining center sill 26 to side sills 28 and 30. There are end sills 158 at either end of the car, and laterally extending stub walls 180. There are lateral catwalks 184 that run across the end of car 20 inboard of end sill 158 and stub wall 180. The major lateral structural connection along the car is provided by the transverse trough assemblies of troughs 34 to 42.

Half-trough peak assemblies 170 are located at the ends of the car opposite the slope sheet of the next inboard slope sheets of the intermediate slope sheet assemblies 80. Half-trough peak assemblies 170 include a roof or hat 168, a pair of end plates 172, and a set of internal webs 174. The roof or hat 168 may be a bent single sheet that forms the roof peak 166 and, in contrast to the intermediate trough peak assemblies, has only a single side sheet, or skirt, 176, that faces across the trough toward the interior of the car.

The roof or hat or cap 168 may be formed from a bent sheet to form the ridge cap that has an inboard web or skirt 176 and an outboard leg 178 that conform to the profile of internal webs 174. Internal webs 174 have one side that has the same dog-leg profile as webs 146. Outboard leg 178 follows the contour of the outboard edge of webs 174 and terminates at the upper edge of a lateral stub wall 180 that runs across the end of car 20 from the end of side sill 28 to the end of side sill 30. There are webs 182 that lie in the respective planes of webs 54 of draft sill 48 and support the inclined slope sheet support and center sill top flange extension horizontal flange portion 186, and consequently lateral cover plate 188 that extends across car 20 from top chord to top chord of side sills 28, 30. Accordingly, the structure defines a continuous stub wall at the end of car 20. The trough facing skirt, namely skirt 176, is mounted with a gap between its lowermost margin and the uppermost margin of the nearest slope sheet 86, 88 such that there is no shear web continuity between the skirt and the slope sheet.

Figure 7A:
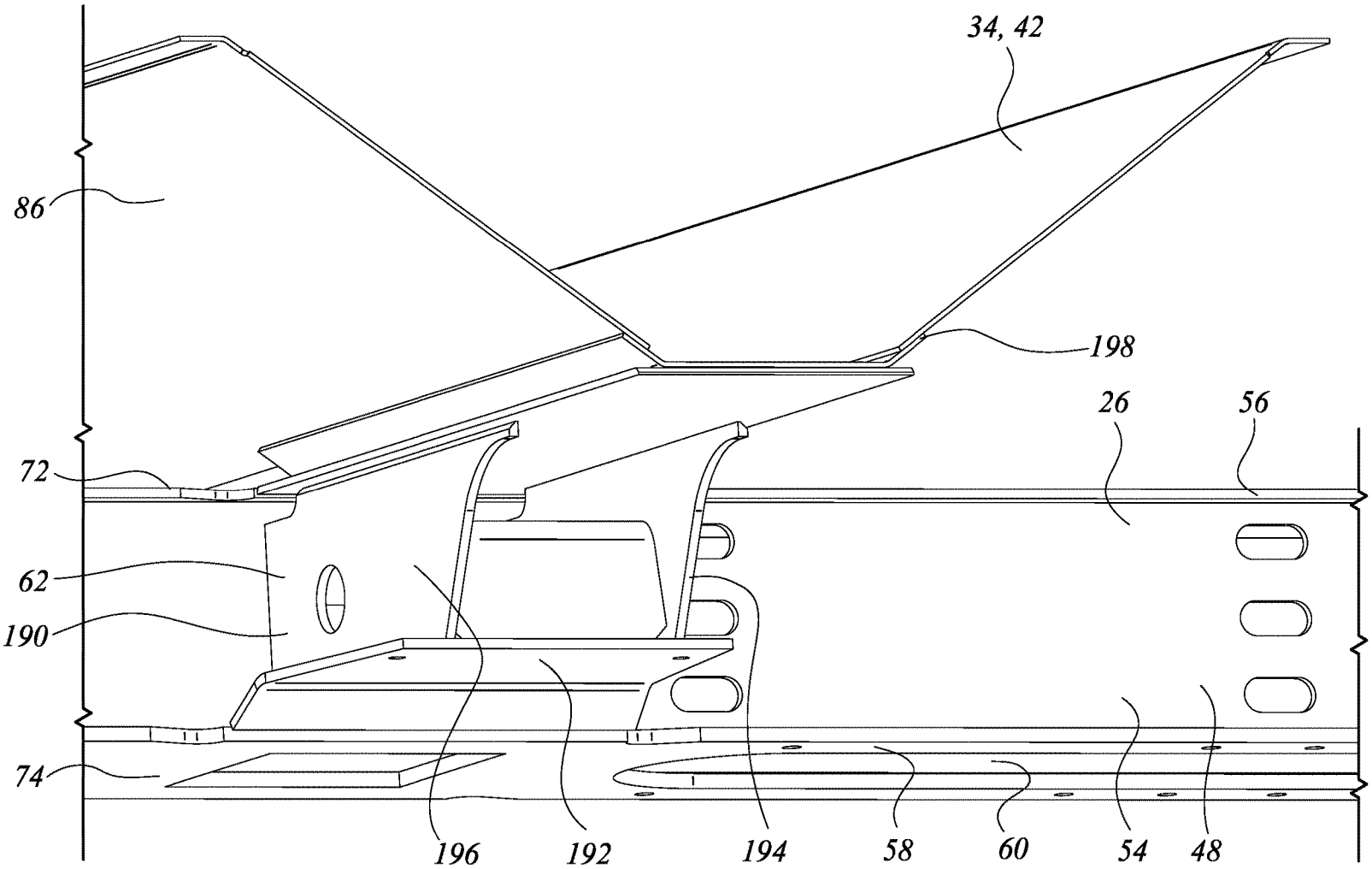
FIG. 7*a* is a perspective view of the main bolster of the coil car of FIG. 1*a;*
Figure 7B:
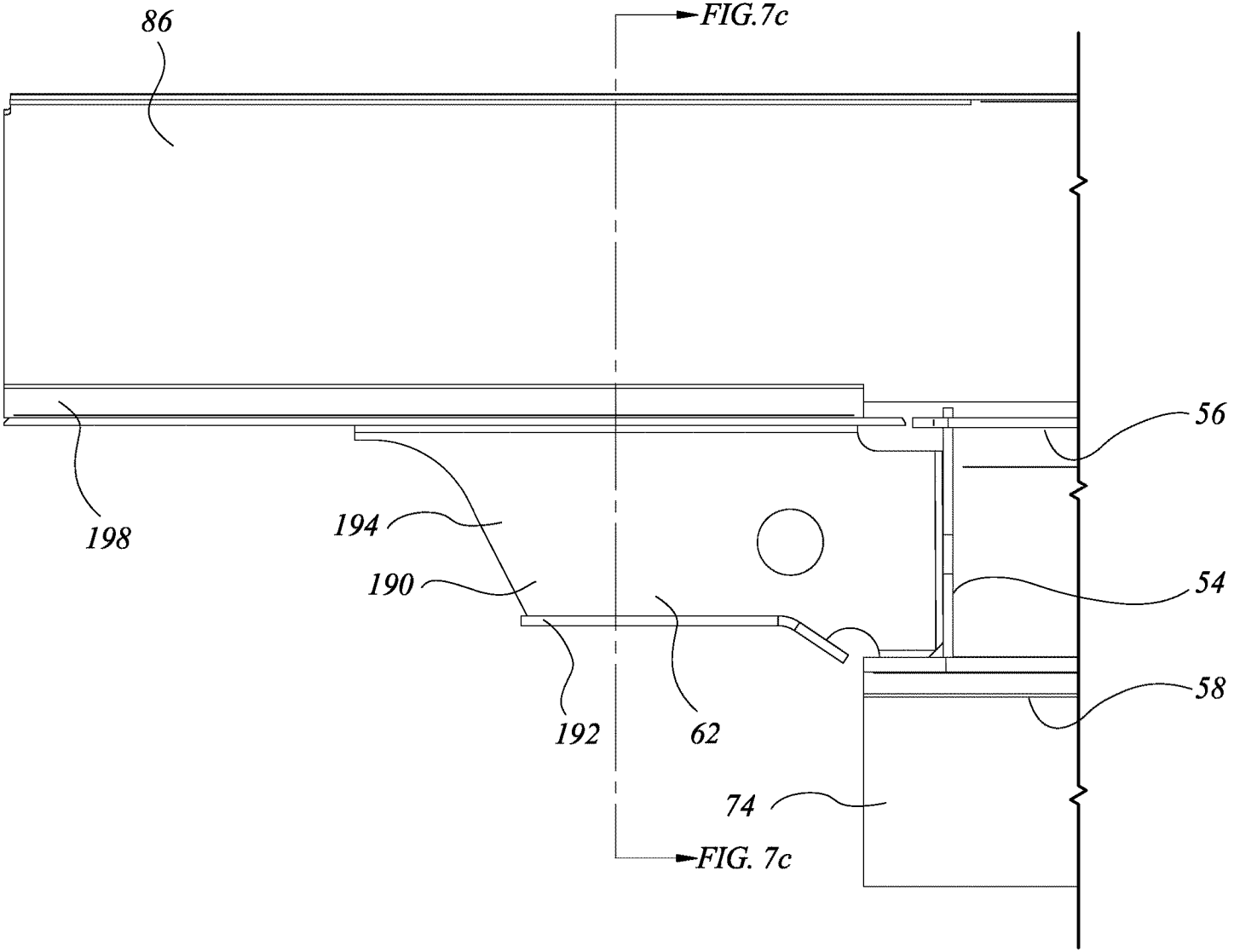
FIG. 7*b* is an end view along the draft sill of the main bolster of FIG. 1*a*.
Figure 7C:
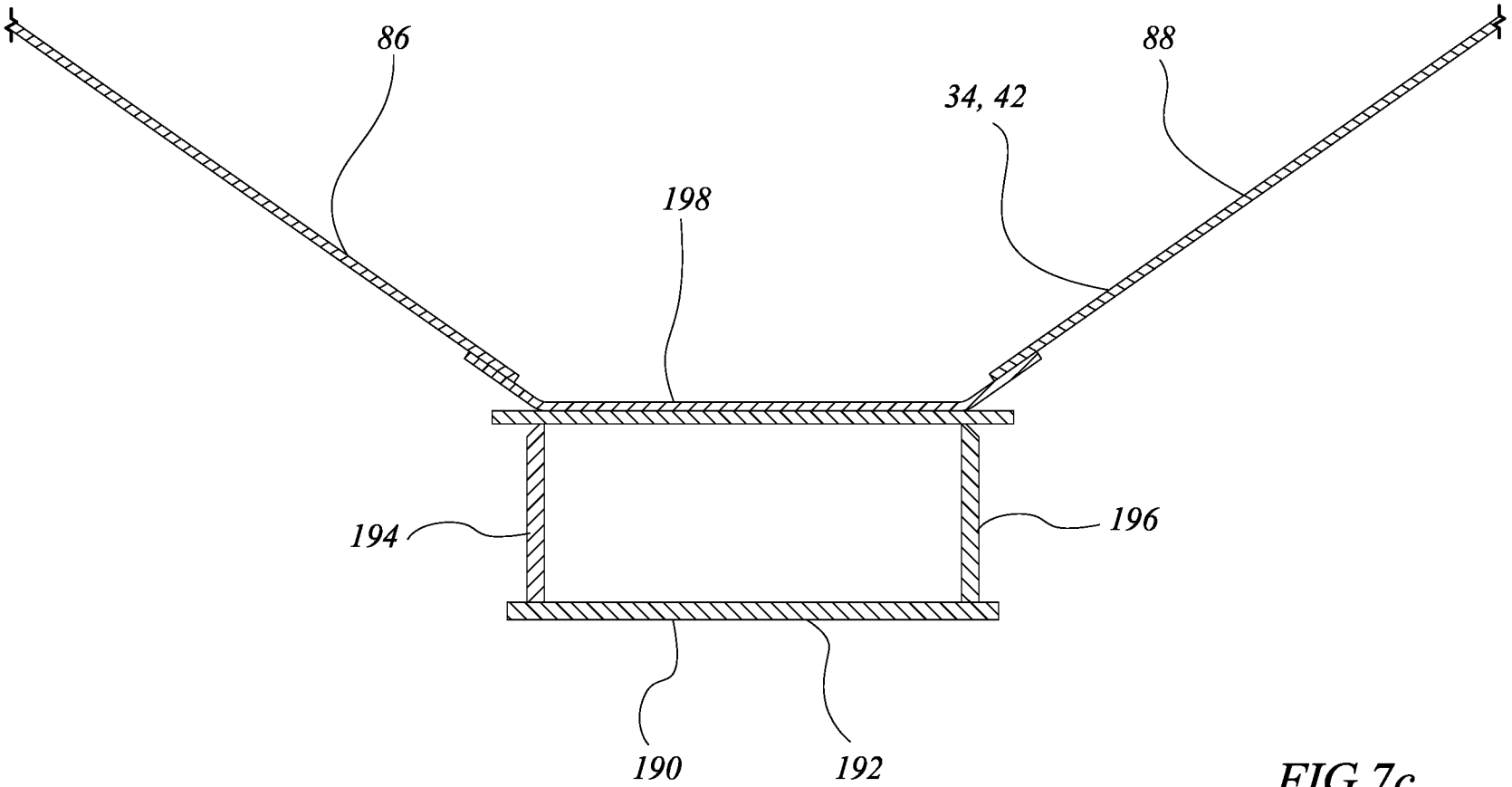
FIG. 7*c* shows a view of the main bolster of FIG. 7*b* on section '7*c*-7*c*'.

First trough 34 and last trough 42 are centered on the respective truck centers. As seen in FIGS. 7*a*, 7*b* and 7*c*, there is a stub bolster 190. It has a bottom flange 192, a pair of vertical webs 194, 196 spaced apart from each other and that stand upwardly from bottom flange 192. At the location of the truck centers, the top flange 72 of center sill 26 is broadened locally. At these locations, the respective trough bottoms 198 are welded to the upper margins of webs 194, 196. Vertical webs 194, 196 and bottom flange 192 terminate laterally outboard of the side bearing mount. From that point to side sill 28, 30, trough 34 and trough 42 function as the lateral bolsters of the car. That is, trough bottom 198 forms the flange of the bottom of a channel, and slope sheets 86, 88 form the legs of that channel, with that hybrid channel performing the role of the main bolster.

This approach may tend to make manufacture easier, and to reduce the amount of material used. The geometry of the trough sheet at the bolster location is a large, wide, flat-bottomed V-shape. This geometry, by itself, has a large second moment of area, reducing dependence on the bolster for stiffness in transferring side bearing loads to the center sill and carrying the side sill. By using the natural beam-like properties of the trough sheet and its geometry, the bolster can be reduced to a stub-bolster that bears the side bearing loads, and a trough sheet that performs the beam function customarily provided by a traditional bolster. In the example, the bolster top flange is partially or wholly eliminated relative to standard designs.

Figure 8:
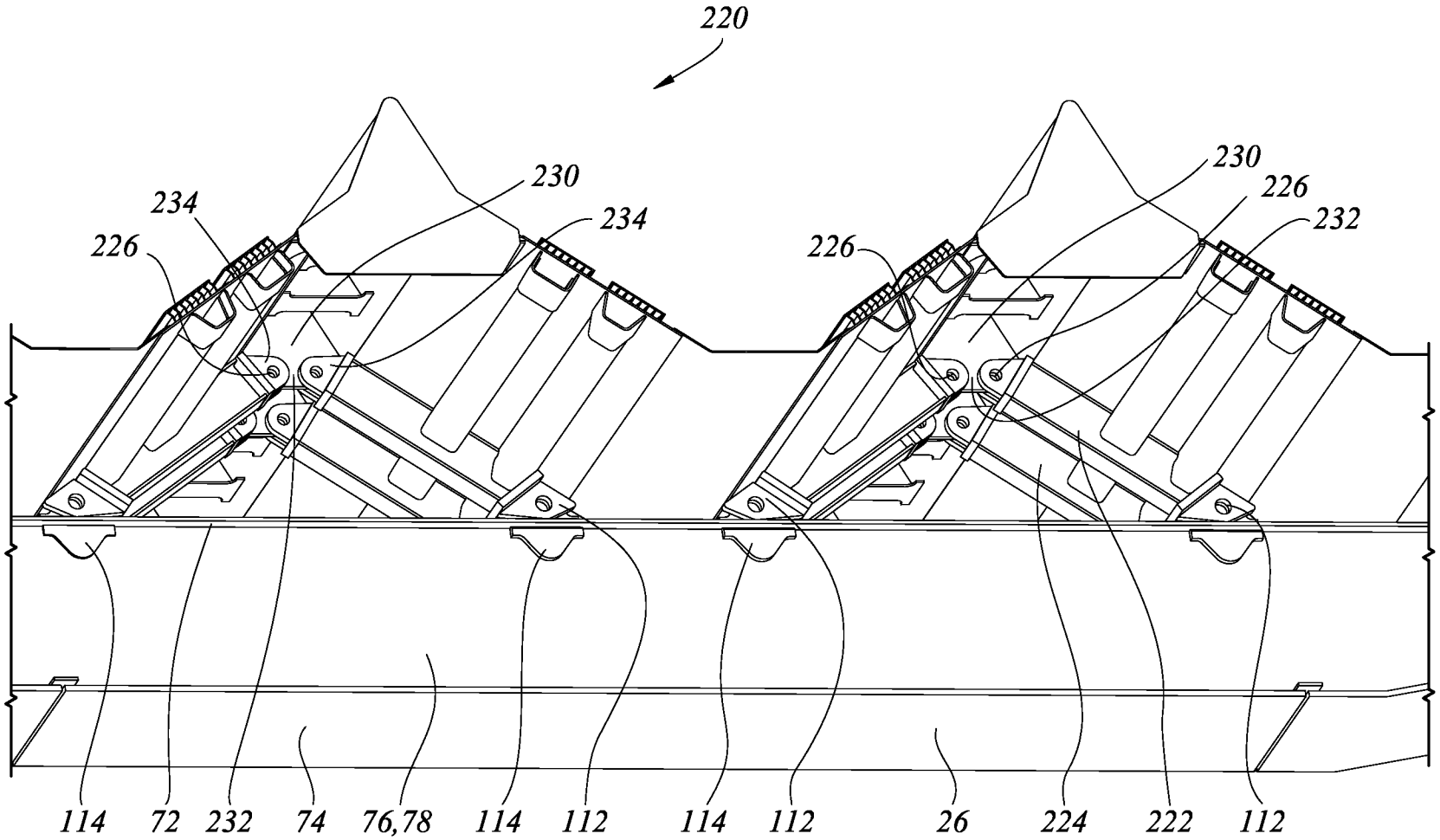
FIG. 8 shows a view showing an alternate arrangement to that of FIG. 5*a*.

In an alternate embodiment shown in FIG. 8, there is a railroad coil car 220 that can be taken as being the same as coil car 20. It differs insofar as legs 222 and 224 are pin jointed not only at the lower end at pin 112, but also at the upper end at pins 226. That is, head frame 230, rather than being rigidly welded to the upper ends of legs 222, 224 has hard points 232 than engage upper devises 234 of legs 222, 224, at a tongue-and-clevis joint, being joined by pins 226 in double shear. Given that the axis of pins 226 is in the y-direction, the pin joint is not able to transmit a bending moment in the x-z plane.

In review, there is a railroad coil car 20. It has a straight-through center sill 26 and a set of transverse troughs 32 that includes at least a first transverse trough 34 and a second transverse trough 36. There is an intermediate slope sheet assembly 44 having a first slope sheet 86 of first trough 34 and a first slope sheet 88 of second trough 36. Intermediate slope sheet assembly 44 is pin-joint connected to straight-through center sill 26.

Center sill 26 has a planar top cover plate 72. The pin-joint connection has a root or footing 102 having web continuity through top cover plate 72 of said center sill 26 by means of side plates 108, 110 and a doubler 114. Center sill 26 is a fish belly center sill, the fish belly being identified at 75. In an alternate version, first slope sheet 86 of first trough 34 is pin-jointed to both center sill 26 and pin-joint connected to a first trough peak assembly 94. Center sill 26 has one of (a) a clevis such as defined by root side plates 108, 110; and (b) a tongue, such as tongue 106; and first slope sheet 86 has the other of (a) a tongue such as tongue 106 and (b) a clevis such as defined by root side plates 108, 110, and the respective tongue and clevis are connected by a pin such as pin 112 to define the pin joint, i.e., a joint that functions as a hinge and does not transmit a bending moment.

Intermediate slope sheet assembly 44 has at least one A-frame structure 82, 84 having a pair of first and second legs 96, 98, each of first and second legs 96, 98 having a foot that is pin-joint connected to center sill 26. Intermediate slope sheet assembly 44 has two of said A-frame structures 82, 84. A-frame structure 82 is aligned with first web 76 of center sill 26, and second A-Frame structure 84 is aligned with second web 78 of center sill 26 spaced apart from first web 76. Intermediate slope sheet assembly 44 includes a head frame 100. First and second legs 96, 98 of A-frame structure 82, 84 have uppermost ends connected to head frame 100. Head frame 100 has a web 122 that has a profile of trough peak 94 of intermediate slope sheet assembly 44.

First slope sheet 86 has a first lateral reinforcement 90. It has a termination at side sill 28, 30 of coil car 20. Reinforcement 90 is a stringer 130 that has a cuff 134 rigidly connected to side sill 28, 30. Cuff 134 is adjustable on fit-up during assembly, and is fixed rigidly to stringer 130 on assembly. First slope sheet 86 has a second lateral reinforcement 92 in the form of a stringer 132 that extends cross-wise behind slope sheet 86 (or 88). Stringer 130 is a lower reinforcement and stringer 132 is an upper reinforcement. Upper stringer 132 has a different cross-section from lower stringer 130. Upper stringer 132 has a greater second moment of area in bending perpendicular to said first slope sheet than has lower stringer 130, a greater sectional thickness, and a greater weight of metal per lineal unit of run. Lower stringer 130 is a channel section having splayed legs. Upper stringer 132 is a channel section having parallel legs. Upper stringer 132 has a greater flexural modulus, EI, than lower stringer 130. Intermediate slope sheet assembly 44 has and cap plates 140. End cap plates 140 are welded to side sills 28, 30 of coil car 20.

Various embodiments have been described in detail. Since changes in and or additions to the above-described examples may be made without departing from the nature, spirit or scope of the invention, the invention is not to be limited to those details but only by a purposive reading of the claims as required by law. As may be understood without further multiplication and repetition of description, the various features of the several embodiments may be mixed and matched as appropriate.

What is claimed is:

1. A railroad coil car, said railroad coil car being a transverse trough coil car, said railroad car comprising:

a straight-through center sill;

a set of transverse troughs that includes at least a first transverse trough and a second transverse trough;

an intermediate slope sheet assembly defining a first slope sheet of said first trough and a first slope sheet of said second trough; and said intermediate slope sheet assembly being pin-joint connected to said straight-through center sill.

2. The railroad coil car of claim 1 wherein said center sill has a planar top cover plate.

3. The railroad coil car of claim 1 wherein said center sill has a top cover plate and said pin-joint connection has a root having web continuity through said top cover plate of said center sill.

4. The railroad coil car of claim 1 wherein said center sill is a fish belly center sill.

5. The railroad coil car of claim 1 wherein said first slope sheet of said first trough is pin-jointed to both said center sill and pin-joint connected to a first trough peak.

6. The railroad coil car of claim 1 wherein said center sill has one of (a) a clevis; and (b) a tongue; and said first slope sheet has the other of (a) a tongue and (b) a clevis, and the respective tongue and clevis are connected by a pin to define said pin joint.

7. The railroad car of claim 1 wherein said intermediate slope sheet assembly includes at least one A-frame structure having a pair of first and second legs, each of said first and second legs having a foot that is pin-joint connected to said straight-through center sill.

8. The railroad coil car of claim 7 wherein said intermediate slope sheet assembly has two of said A-frame structures, a first of said A-frame structures being aligned with a first web of said center sill, and a second of said A-Frame structures being aligned with a second web of said center sill spaced apart from said first web.

9. The railroad coil car of claim 7 wherein said intermediate slope sheet assembly includes a head frame member, and said first and second legs of said at least one A-frame have uppermost ends connected to said head frame.

10. The railroad coil car of claim 9 wherein said head frame has a web that has a profile defining a trough peak form of said intermediate slope sheet assembly.

11. The railroad coil car of claim 1 wherein said first slope sheet has at least a first lateral reinforcement, said first lateral reinforcement having a termination at a side sill of said coil car; and said reinforcement having a cuff rigidly connected to said side sill, said cuff being adjustable on fit-up during assembly, and said cuff being rigidly fixed to said reinforcement on assembly.

12. A railroad coil car, said railroad coil car being a transverse trough coil car, said railroad car comprising:

a straight-through center sill;

a set of transverse troughs that includes at least a first transverse trough and a second transverse trough;

an intermediate slope sheet assembly defining a first slope sheet of said first trough and a first slope sheet of said second trough; and said intermediate slope sheet assembly being pin-joint connected to said straight-through center sill;

said first slope sheet has at least a first lateral reinforcement and a second lateral reinforcement extending cross-wise behind said slope sheet;

said first lateral reinforcement being a lower reinforcement and said second lateral reinforcement being an upper reinforcement; and said upper reinforcement has a different cross-section from said lower reinforcement.

13. The railroad coil car of claim 12 wherein said upper reinforcement has at least one of: (a) a greater second moment of area in bending perpendicular to said first slope sheet than has said lower reinforcement; (b) a greater sectional thickness than said lower reinforcement; and (c) a greater weight of metal per lineal unit of run than said lower reinforcement.

14. The railroad coil car of claim 12 wherein said lower reinforcement is a channel section and said channel section has splayed legs.

15. The railroad coil car of claim 12 wherein said upper reinforcement is a channel section having parallel legs; said lower reinforcement is a channel section having splayed legs; and said upper reinforcement has a greater flexural modulus, EI, than has said lower reinforcement.

16. The railroad coil car of claim 1 wherein said intermediate slope sheet assembly has end cap plates, and said end cap plates are welded to side sills of said coil car.

* * * * *